US005777297A

United States Patent [19]

Gelus et al.

[11] Patent Number: 5,777,297

[45] Date of Patent: Jul. 7, 1998

[54] HEATING STRUCTURE IN THE FORM OF A SANDWICH AND HOUSEHOLD ELECTRICAL APPLIANCE INCORPORATING SUCH STRUCTURE

[75] Inventors: Dominique Gelus, Eyzin; Jean-Louis Brandolini, Saint Etlanne, both of France

[73] Assignee: SEB S.A., Ecully, France

[21] Appl. No.: 610,652

[22] Filed: Mar. 4, 1996

[30] Foreign Application Priority Data

Mar. 2, 1995 [FR] France ..... 95 02666

[51] Int. Cl.[6] ..... H05B 3/30; D06F 75/08

[52] U.S. Cl. ..... 219/254; 219/544; 219/542

[58] Field of Search ..... 219/245, 254, 219/255, 544, 542, 540, 522, 203, 505, 457, 462, 463; 338/254, 255, 250, 275, 306; 392/432, 435; 38/77.1; 29/611

[56] References Cited

U.S. PATENT DOCUMENTS

| | | | |
|---|---|---|---|
| 1,472,185 | 10/1923 | Mollenhauer | 219/544 |
| 4,860,434 | 8/1989 | Louison et al. | 428/363 |
| 5,100,494 | 3/1992 | Schmidt | 219/544 |

FOREIGN PATENT DOCUMENTS

| | | | |
|---|---|---|---|
| 555 159 | 1/1993 | European Pat. Off. . | |
| 822661 | 1/1938 | France | 392/438 |
| 3530690 | 3/1987 | Germany | 392/435 |
| 1085784 | 10/1967 | United Kingdom . | |
| 1102125 | 2/1968 | United Kingdom . | |
| 1102126 | 2/1968 | United Kingdom | 219/254 |

*Primary Examiner*—John A. Jeffery
*Attorney, Agent, or Firm*—Pillsbury Madison & Sutro

[57] ABSTRACT

A heating structure in the form of a sandwich is composed of first and second external elements, each having a face which is directed toward the other element, with the first external element constituting a heating plate, and the heating structure further including a heating unit interposed between the first and second external elements. The heating unit includes at least one substantially flat resistive heat generating element; a first layer of thermoplastic resin in which the heat generating element is embedded; an upper electrical insulating sheet and a lower electrical insulating sheet between which the resistive heat generating element and the first layer of thermoplastic resin are interposed to form a sandwich structure, with the first layer of thermoplastic resin adhering to each of the electrical insulating sheets; and at least one second layer of thermoplastic resin contacting one of the external elements and adhering the one of the external elements to the heating unit. The heating unit further includes at least one further electrical insulating sheet contacting, and adhering to, the at least one second layer of thermoplastic resin; and an intermediate layer of adhesive material interposed between, and adhering to, one of the upper and lower electrical insulating sheets and the at least one further electrical insulating sheet.

22 Claims, 1 Drawing Sheet

HEATING STRUCTURE IN THE FORM OF A SANDWICH AND HOUSEHOLD ELECTRICAL APPLIANCE INCORPORATING SUCH STRUCTURE

BACKGROUND OF THE INVENTION

The present invention relates to the general technical field of flat heating structures, of the sandwich type, intended to perform a function of heating to high temperatures, currently exceeding 180° C.

The present invention relates more specifically to a heating structure, particularly for household electrical appliances, which structure is of the sandwich type and is limited exteriorly by at least one heating plate and comprising a heating unit including at least one flat resistive element embedded in a first layer of thermoplastic resin constituting a sandwich with two electrical insulating sheets each adhering to the first layer of thermoplastic resin. The heating unit is joined to the heating plate by at least one second layer of thermoplastic resin.

Such a heating structure forms a flat heating element as described in Applicants' Published European application EP555159. Such a heating structure is more particularly, but not exclusively, intended to constitute the heating element of a clothes pressing iron which may be of the steam type of the dry type, and to assure the primary function of heating for clothes pressing and the possible secondary function of generation of steam. Such heating elements can also be employed in a non-limiting manner in any household electric appliance in which thermal energy must be generated, such as fryers, all types of toasters, radiant or convection heating plates, or even steam generators which are self-contained or are connected to clothes pressing irons, or even electric boilers, such as those provided in electric coffee makers.

Among all of the applications to which reference has been made above, the heating structure is integrated in an advantageous manner in a clothes pressing iron of the steam or dry type, and the present invention concerns equally directly a clothes pressing iron provided with such a heating structure.

The heating structure disclosed in the above-cited French application has been found to fulfill in a satisfactory manner the function for which it was designed, without exhibiting, contrary to expectations, a deterioration in the condition, or quality, of the various layers constituting the sandwich structure, and this despite the high operating temperatures which currently exceed 180° C.

In such structures, use of thermoplastic resins offers numerous advantages, particularly with regard to fabrication, heat dissipation and protection of the resistive element, and this despite the problems which might have been expected to be encountered at the high operating temperature due to the reversibility of the state of thermoplastic resins subjected to such operating temperatures.

Flat heating elements designed according to this principle consequently provide overall satisfaction, but it appears that operation of such heating elements can result in the generation of a leakage current starting from the sandwich structure of the heating element. In effect, the thicknesses of the electric isolating sheets are sufficiently small and can lead, when electric current is supplied to the heating element, to the generation of an electric field in the nonconductive space existing between the conductive surfaces formed by the resistive element and the heating plates. In such a case, the flat heating element is similar to a capacitor furnishing a leakage current. The generation of a leakage current, even if small, should be avoided and the current should in any event be maintained below a value permitted by the standards recognized in the technical field under consideration.

SUMMARY OF THE INVENTION

Consequently, an object of the present invention is to eliminate the problems mentioned above, and to furnish a high temperature heating element of sandwich structure in which the electricity is confined in order to reduce, and even completely suppress, the generation of a leakage current in the heating structure.

Another object of the invention is to provide a heating structure in which the thermal transmission is improved and the manufacturing cost reduced, while assuring that the heating structure will remain in good condition for a long time period.

The above and other objects are achieved, according to the present invention, by a heating structure in the form of a sandwich, the structure comprising first and second external elements, each having a face which is directed toward the other element, with the first external element constituting a heating plate, and the heating structure further comprising a heating unit interposed between the first and second external elements, wherein the heating unit comprises: at least one substantially flat resistive heat generating element; a first layer of thermoplastic resin in which the heat generating element is embedded; an upper electrical insulating sheet and a lower electrical insulating sheet between which the resistive heat generating element and the first layer of thermoplastic resin are interposed to form a sandwich structure, with the first layer of thermoplastic resin adhering to each of the electrical insulating sheets; and at least one second layer of thermoplastic resin contacting one of the external elements and adhering the one of the external elements to the heating unit, and wherein the heating unit further comprises: at least one further electrical insulating sheet contacting, and adhering to, the at least one second layer of thermoplastic resin; and an intermediate layer of adhesive material interposed between, and adhering to, one of the upper and lower electrical insulating sheets and the at least one further electrical insulating sheet.

Other particularities and advantages of the invention will appear more clearly from the following description, presented with reference to the attached drawing, of a preferred embodiment of the invention which is given by way of nonlimiting example.

DESCRIPTION OF THE PREFERRED EMBODIMENTS

Figure 1:
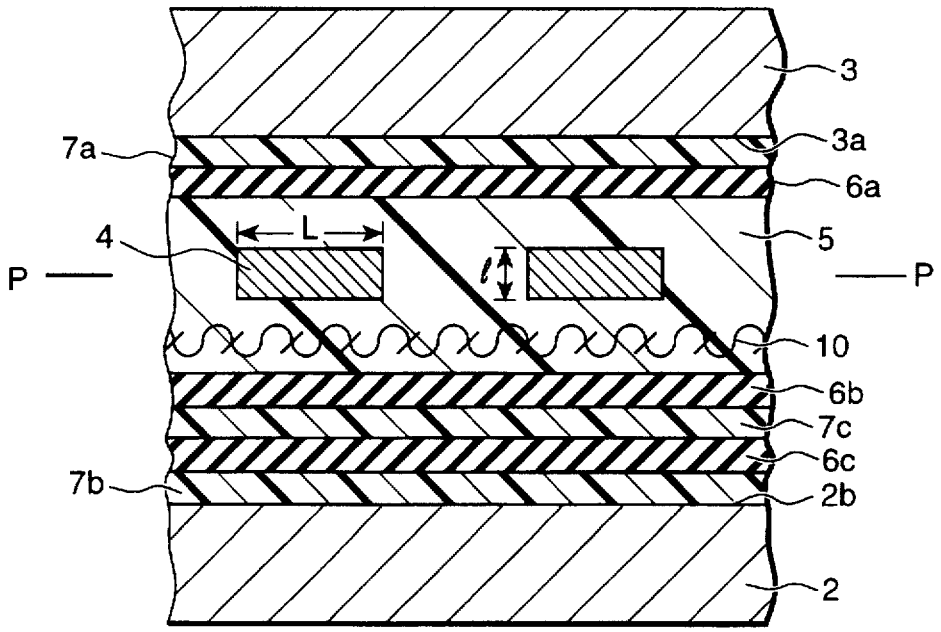
FIG. 1 is a cross-sectional side view of a preferred embodiment of a heating structure according to the invention.

The heating structure 1 according to the invention, as shown in FIG. 1 is of the high temperature type and is fabricated as a sandwich structure constituted by a stack of a plurality of layers bounded to the outside by two heat diffusing elements forming, respectively, a lower plate 2 and an upper plate 3. The temperatures currently produced in such a structure exceed 1800° C. or 200° C. and preferably even approach 300° C. Plates 2 and 3 can be fabricated from any rigid or flexible materials currently utilized for elements intended to diffuse, or transfer, heat, such as stainless steel, soft steel, ceramics, vitrocrystalline materials and glass, for example, as well as aluminum, this latter material being particularly advantageous in the case of a heating structure provided for use in a clothes pressing iron. Plates 2 and 3 can both be made of the same material, or can be made of respectively different materials, depending on the requirements of the device in which they are employed, and can have the same or respectively different thicknesses. In the embodiment illustrated in the Figure, and in the case of a heating structure for use in a clothes pressing iron, plate 2 forms the ironing sole plate while plate 3 forms the base of the steam generating chamber.

The heating structure includes a heating unit fabricated in the form of a substantially flat resistive element 4 constituted by one or several strips extending in the same plane along a defined path forming a series of loops and/or having a serpentine or other form between plates 2 and 3. Preferably, resistive element 4 and the loops which it forms extend in a longitudinal plane of symmetry, P, of heating structure 1. Resistive element 4 can be made of any materials currently utilized for a heating strip, such as nickel-chrome alloys or indeed, in a preferred manner, constantan or alloys based on constantan. The cross section and length of resistive element 4 are selected on the basis of the desired electric power. Advantageously, its thickness (1) is of the order of 50 μm and can vary between 20 and 100 μm for example; its width (L) is of the order of 1 mm and can vary between 0.5 mm and 3 mm.

Construction of the heating structure is completed by insertion of resistive element 4 in a first layer 5 of thermoplastic resin, covering at least the upper and lower surfaces of resistive element 4. In a conventional manner, resistive element 4 is provided with electrically insulating coatings constituted by an upper sheet **6*a* and a lower sheet 6*b*, each adhering to a respective one of the faces of the first layer 5 of thermoplastic resin and defining, in consequence, the heating unit. The material utilized for the electrically isolating coating can obviously be selected from among all of the conventional compositions currently utilized in the art, taking into account the existing thermal requirements imposed on the heating structure. In the framework of a utilization of the heating structure for a household electrical appliance, such as a clothes pressing iron, it is particularly advantageous to make use of an electrical insulating material selected from among thermosetting resins, and preferably selected from among polyimide resins and silicone resins. Advantageously, all of the electrically insulating sheets 6*a*, 6*b*** are made of the same material.

Plates 2 and 3 have respective faces **2*b* and 3*a* which face one another. Connection, or bonding, means assuring adhesion between each of faces 2*b* and 3*a*, on the one hand, and corresponding exterior faces of electrical insulation sheets 6*a* and 6*b*, on the other hand, comprises at least one other layer of thermoplastic resin, forming an upper second layer 7*a* and a lower second layer 7*b***.

According to the invention, the electrical insulation of the heating structure is improved, and leakage currents are reduced, by disposing at least one supplemental electrical insulating sheet **6*c* between one of layers 7*a* and 7*b* and one of insulating sheets 6*a* and 6*b*. This supplemental sheet 6*c* is associated with an intermediate layer 7*c* of an adhesive material suitable for providing a bond between the electrical insulating sheet 6*a*or 6*b* and the supplemental sheet 6*c*. The thickness of each of the electrical insulating sheets 6*a*, 6*b* and 6*c*** is between 15 μm and 100 μm, and preferably substantially equal to 25 μm.

Advantageously, as shown in the Figure, the intermediate layer **7*c* is positioned at the lower side of the heating structure, i.e. between element 4 and heating plate 2** which forms the pressing sole plate.

The adhesive material of intermediate layer **7*c*** can be a silicone glue or preferably a thermoplastic resin.

In preferred forms of construction of heating structures according to the invention, the respective bonds between plates 2 and 3 and the electrical isolation coating sheets **6*a*, 6*b* and 6*c*** are each constituted by a single, homogeneous layer of thermoplastic resin.

In order to promote a constant, or uniform, heat dissipation throughout the thickness of the sandwich structure, the thermoplastic material utilized for each of the thermoplastic resin layers **7*a*, 7*b*, 7*c* and 5 will preferably have the same composition in each of those layers. It is however possible to utilize different thermoplastic materials for the various layers, depending on the type of thermal stress to which heating structure 1 will be subjected, or even to make only the first layer 5 of thermoplastic resin of a material different from the other layers 7*a*, 7*b* and 7*c*. In an advantageous manner at least layers 7*a*, 7*b* and 7*c* will be made of the same material, and preferably also the first resin layer 5. The thickness of intermediate layer 7*c* of thermoplastic resin and of each second layer 7*a*, 7*b* of thermoplastic resin is between 10 μm and 100 μm, and preferably substantially equal to 25 μm, while the first layer 5** of thermoplastic resin has a thickness between 35 μm and 150 μm and preferably substantially equal to 100 μm.

The selection of thermoplastic resin depends of course on the thermal stresses imposed on the heating structure and in the framework of a specific use in household electrical appliances and in particular steam pressing irons, preference is given to PFA (perfluoroalkoxy) or PEEK (polyetherethercetone) for each of the thermoplastic resin layers. Of course, depending on the thermal stresses to which the heating structure will be subjected during normal operation, other thermoplastic materials can be utilized, such as PTFE (polytetrafluorethylene) or even FEP (tetrafluorethylene hexafluoropropylene-nomenclature obtained from volume 1 of Editions WEKA), for example.

It can also be envisioned to simplify the heating structure 1 according to the invention by eliminating one layer of thermoplastic resin, and for example the upper layer **7*a*. In such a modified embodiment, only the lower plate 2 performs a specific thermal diffusion function, rigid element 3 delimiting the upper part of the heating structure 1 and performing mainly a mechanical stiffening function and secondarily a thermal diffusion function. In this alternative embodiment, rigid element 3 rests directly on upper electrical insulating coating sheet 6*a*** and can be constituted by a series of strips which are spaced from one another.

According to the preferred embodiment of the invention shown in the Figure, there is additionally provided a fabric layer 10, preferably a glass fabric, which is impregnated by material of thermoplastic resin layer 5. Electrical isolation is obtained by cooperation of the thermoplastic resin layer 5 and the fabric. In the example shown in the Figure, the mass of thermoplastic resin of layer 5 is advantageously constituted by three layers of PEEK and one sheet of fabric 10 with thermoplastic material and located below resistive element 4. The sheet of fabric 10 also performs a mechanical supporting function in the heating structure guaranteeing with the thermoplastic resin a good electrical insulation in case of overheating of the strips of resistive element 4. The presence of at least one sheet of glass fabric also facilitates formation of the sandwich structure by avoiding contraction of the resin layers, thereby positively influencing the flatness of the final product. The thickness of the resin layers 7a, 7b, 7c forming the bonding means between plates 2 and 3 is preferably less than that of the sheet of fabric 10.

The heating structure according to the invention can be produced according to the manufacturing process described in U.S. application No. 08/008,101, filed Jan. 25, 1993, which is incorporated herein by reference.

In the preferred implementation of the invention, which is in clothes pressing irons, preferably steam irons, the thickness of each of the thermoplastic resin layers 7a, 7b and 7c will preferably be of the order of about 25 μm, while the thickness of the resistive element 4 itself will be of the order of 50 μm (0.05 mm), and the thickness of the electrical insulating sheets 6a, 6b and 6c will be around 25 μm (0.025 mm). The final thickness of the first layer 5 of thermoplastic resin is of the order of 75 μm, after completion of the assembly procedure and fusing together of the three initial layers of resin each having a thickness of 25 μm. Layer 10 of glass fabric has a thickness of between 40 μm and 100 μm, and is preferably substantially equal to 50 μm.

Advantageously, the material of the upper and lower plates 2 and 3, as well as the thermoplastic material, will be selected in a manner to have substantially equal thermal expansion properties in a manner to provide a substantially constant temperature gradient throughout the thickness of the sandwich structure.

Also advantageously, the upper and lower plates 2 and 3 will be constituted by metal plates of aluminum, resistive element 4 being preferably made of constantan while the three electrical isolating sheets 6a, 6b, 6c will each be constituted by a layer of polyimide.

The heating structure according to the invention thus presents, as a result of the advantageous presence of a plurality of layers of thermoplastic resin, on the one hand good properties of heat transmission between the different layers, and on the other hand also a good resistance to mechanical and thermal shocks, all of this while retaining good adhesion properties between the different layers.

The fabrication of such a heating structure does not require recourse to a costly and complex manufacturing installation and the cost of such a heating structure can, as a result, be substantially reduced. In the same manner, the dielectric properties of the heating structure can be improved and obtained at a minimal cost, by limiting the quantity of thermoplastic material utilized to form the first resin layer 5. It should equally be noted that the heating structure according to the invention, and particularly the clothes pressing iron containing such a heating structure, is well sealed against the introduction of moisture, and particularly steam, this property being achieved at minimum cost. The heating structure permits, in addition, an excellent mastery of the distribution of heat to the ironing sole plate, which can allow a uniform distribution of heat or the creation of differentiated thermal zones maintained at different temperatures.

Finally, it will be noted that the incorporation of a heating structure according to the invention in the ironing sole plate of a steam iron permits, due to the good heat dissipation properties of the heating structure, mounting of the steam generating chamber directly above the upper plate of the sandwich structure. There results therefrom a significant simplification of the internal structure of the pressing iron, influencing in a positive manner the cost and ease of manufacture. The heating structure according to the invention is incorporated preferably in a steam iron, but it is obvious that its use can extend to any type of pressing iron in general, and equally to cooking receptacles of the fryer type, appliances employed for toasting or grilling, or those in which steam is generated, such as in coffee makers or boilers, for example.

Figure 2:
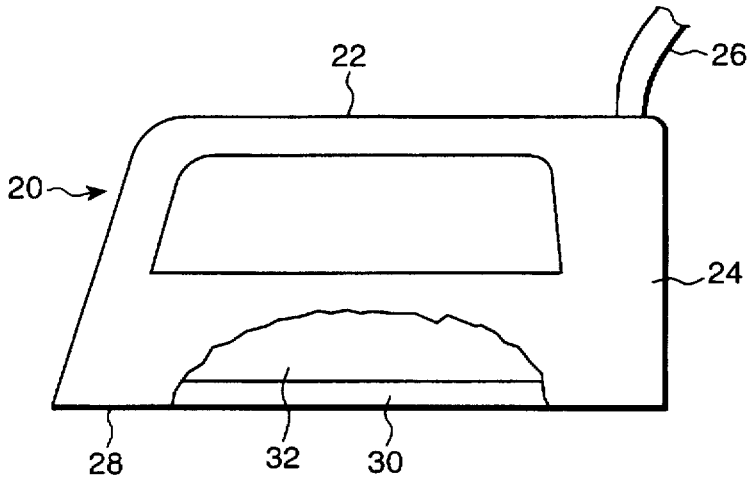
FIG. 2 is an elevational view, partly broken away, of a steam iron equipped with the heating structure of FIG. 1.

FIG. 2 shows a steam iron 20 equipped with a heating structure according to the present invention. Apart from the heating structure itself, the iron is entirely conventional.

Iron 20 includes a handle 22, a base 24 and an electric power cord 26 which extends into the interior of iron 20. The bottom surface of base 24 is an ironing sole plate. Base 24 contains a heating structure 30 which will be constituted by the heating structure shown in FIG. 1. That heating structure includes a lower plate which constitutes ironing sole plate 28. Base 24 is shown partly broken away in order to illustrate the location of heating structure 30.

Above heating structure 30 there is disposed a steam generating chamber 32. Heat generated by structure 30 will act to vaporize water in chamber 32. As mentioned earlier herein, the upper plate 3 shown in FIG. 1 will form the base of steam generating chamber 32.

This application relates to subject matter disclosed in French Application number 95 02666, filed on Mar. 2, 1995, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. Heating structure in the form of a sandwich, said structure comprising first and second external elements, each having a face which is directed toward the other element, with said first external element constituting a heating plate, and said heating structure further comprising a heating unit interposed between said first and second external elements, wherein said heating unit comprises:

at least one substantially flat resistive heat generating element;

a first layer of thermoplastic resin in which said heat generating element is embedded;

an upper electrical insulating sheet and a lower electrical insulating sheet between which said resistive heat generating element and said first layer of thermoplastic resin are interposed to form a sandwich structure, with said first layer of thermoplastic resin adhering to each of said electrical insulating sheets; and at least one second layer of thermoplastic resin contacting one of said external elements and adhering said one of said external elements to said heating unit, and wherein said heating unit further comprises:

at least one further electrical insulating sheet contacting, and adhering to, said at least one second layer of thermoplastic resin; and an intermediate layer of adhesive material interposed between, and adhering to, one of said upper and lower electrical insulating sheets and said at least one further electrical insulating sheet.

2. Heating structure according to claim 1 wherein each of said upper electrical insulating sheet, said lower electrical insulating sheet and said further electrical insulating sheet is made of a thermosetting resin.

3. Heating structure according to claim 2 wherein the thermosetting resin consists of at least one of a polyimide resin and a silicone resin.

4. Heating structure according to claim 2 wherein said upper electrical insulating sheet, said lower electrical insulating sheet and said further electrical insulating sheet are all made of the same material.

5. Heating structure according to claim 1 wherein said upper electrical insulating sheet, said lower electrical insulating sheet and said further electrical insulating sheet each have a thickness of between 15 μm and 100 μm.

6. Heating structure according to claim 5 wherein said upper electrical insulating sheet, said lower electrical insulating sheet and said further electrical insulating sheet each have a thickness substantially equal to 25 μm.

7. Heating structure according to claim 1 further comprising a layer of fabric forming part of said first layer of thermoplastic resin and impregnated by thermoplastic resin.

8. Heating structure according to claim 7 wherein said layer of fabric consists of a glass fabric.

9. Heating structure according to claim 7 wherein said layer of fabric is located between said resistive heat generating element and said first external element.

10. Heating structure according to claim 7 wherein said layer of fabric has a thickness of between 40 μm and 100 μm.

11. Heating structure according to claim 10 wherein said layer of fabric has a thickness substantially equal to 50 μm.

12. Heating structure according to claim 1 wherein said intermediate layer of adhesive material consists of a silicone glue.

13. Heating structure according to claim 1 wherein said intermediate layer of adhesive material consists of a thermoplastic resin.

14. Heating structure according to claim 13 wherein said thermoplastic resin of said intermediate layer consists of a material selected from among PFA, PTFE, FEP and PEEK.

15. Heating structure according to claim 1 wherein said first layer of thermoplastic resin, said at least one second layer of thermoplastic resin and said intermediate layer of adhesive material are all made of the same material.

16. Heating structure according to claim 1 wherein said at least one second layer of thermoplastic resin and said intermediate layer of adhesive material each have a thickness of between 10 μm and 100 μm and said first layer of thermoplastic resin has a thickness of between 35 μm and 150 μm.

17. Heating structure according to claim 16 wherein each of said at least one second layer of thermoplastic resin and said intermediate layer of adhesive material each have a thickness substantially equal to 25 μm.

18. Heating structure according to claim 16 wherein said first layer of thermoplastic resin has a thickness substantially equal to 100 μm.

19. In a household electric appliance comprising a receptacle for holding a product to be heated and a heating structure disposed for heating the product, the improvement wherein said heating structure is in the form of a sandwich and comprises first and second external elements, each having a face which is directed toward the other element, with said first external element constituting a heating plate, and said heating structure further comprising a heating unit interposed between said first and second external elements, wherein said heating unit comprises:

at least one substantially flat resistive heat generating element;

a first layer of thermoplastic resin in which said heat generating element is embedded;

an upper electrical insulating sheet and a lower electrical insulating sheet between which said resistive heat generating element and said first layer of thermoplastic resin are interposed to form a sandwich structure, with said first layer of thermoplastic resin adhering to each of said electrical insulating sheets; and at least one second layer of thermoplastic resin contacting one of said external elements and adhering said one of said external elements to said heating unit, and wherein said heating unit further comprises:

at least one further electrical insulating sheet contacting, and adhering to, said at least one second layer of thermoplastic resin; and an intermediate layer of adhesive material interposed between, and adhering to, one of said upper and lower electrical insulating sheets and said at least one further electrical insulating sheet.

20. In a clothes pressing iron comprising an ironing sole plate and means for heating said sole plate, the improvement wherein said means for heating said sole plate comprises a heating structure in the form of a sandwich, said structure comprising first and second external elements, each having a face which is directed toward the other element, with said first external element constituting said ironing sole plate, and said heating structure further comprising a heating unit interposed between said first and second external elements, wherein said heating unit comprises:

at least one substantially flat resistive heat generating element;

a first layer of thermoplastic resin in which said heat generating element is embedded;

an upper electrical insulating sheet and a lower electrical insulating sheet between which said resistive heat generating element and said first layer of thermoplastic resin are interposed to form a sandwich structure, with said first layer of thermoplastic resin adhering to each of said electrical insulating sheets; and at least one second layer of thermoplastic resin contacting one of said external elements and adhering said one of said external elements to said heating unit, and wherein said heating unit further comprises:

at least one further electrical insulating sheet contacting, and adhering to, said at least one second layer of thermoplastic resin; and an intermediate layer of adhesive material interposed between, and adhering to, one of said upper and lower electrical insulating sheets and said at least one further electrical insulating sheet.

21. The clothes pressing iron according to claim 20 wherein said intermediate layer of adhesive material consists of a thermoplastic resin, said thermoplastic resin consisting of a material selected from among PFA, PTFE, FEP and PEEK.

22. The clothes pressing iron according to claim 20 wherein said sole plate is made of aluminum.

* * * * *